US011344112B1

(12) United States Patent
Chen

(10) Patent No.: US 11,344,112 B1
(45) Date of Patent: May 31, 2022

(54) EXTENDABLE TABLE ASSEMBLY

(71) Applicant: Te-Lung Chen, Tainan (TW)

(72) Inventor: Te-Lung Chen, Tainan (TW)

( * ) Notice: Subject to any disclaimer, the term of this patent is extended or adjusted under 35 U.S.C. 154(b) by 0 days.

(21) Appl. No.: 17/092,418

(22) Filed: Nov. 9, 2020

(51) Int. Cl.
*A47B 1/08* (2006.01)
*A47B 1/10* (2006.01)
*A47B 3/091* (2006.01)
*A47B 1/05* (2006.01)

(52) U.S. Cl.
CPC ..... *A47B 1/08* (2013.01); *A47B 1/05* (2013.01); *A47B 1/10* (2013.01); *A47B 3/0918* (2013.01)

(58) Field of Classification Search
CPC .... A47B 1/05; A47B 1/08; A47B 1/10; A47B 3/0918
USPC ..... 108/69
See application file for complete search history.

(56) References Cited

U.S. PATENT DOCUMENTS 1,576,455 A * 3/1926 Parker ..... A47B 3/0918 108/131
2,474,450 A * 6/1949 Woodruff ..... A47B 3/0916 108/132
2,614,013 A * 10/1952 Langius ..... A47B 1/08 108/69
2,672,387 A * 3/1954 Barricks ..... A47B 3/0918 108/133
2,756,082 A * 7/1956 Pucci ..... A47B 3/0912 403/107
2,784,042 A * 3/1957 Clapper ..... A47B 3/0918 108/132
3,026,160 A * 3/1962 Bisp ..... A47B 3/0918 108/132
3,349,728 A * 10/1967 Barecki ..... A47B 3/0912 108/131
3,416,468 A * 12/1968 Peterson ..... A47B 3/0916 108/131
3,954,068 A * 5/1976 Roberts ..... A47B 3/0918 105/124
5,417,168 A * 5/1995 Soper ..... A47B 3/00 108/124
6,471,173 B1 * 10/2002 Tseng ..... A47B 3/0918 108/132
6,520,094 B2 * 2/2003 Wen ..... A47B 3/0912 108/132
7,140,308 B2 * 11/2006 Tsai ..... A47B 3/087 108/169
9,173,481 B2 * 11/2015 Haansbæk ..... A47B 13/021
(Continued)

*Primary Examiner* — Daniel J Troy
*Assistant Examiner* — Timothy M Ayres
(74) *Attorney, Agent, or Firm* — Karin L. Williams; Alan D. Kamrath; Mayer & Williams PC

(57) ABSTRACT

An extendable table assembly includes a primary board, a support unit mounted on the primary board, a foldable primary stand pivotally connected with the support unit, an extension unit arranged under the primary board and connected with the support unit, a secondary board placed on the extension unit, and a connecting unit mounted between the support unit and the extension unit. The extension unit includes a strut, an enclosure frame connected with the strut and the support unit, and a foldable secondary stand movable with the extension unit. The secondary stand includes two legs pivotally connected with the enclosure frame and a V-shaped brace mounted between the two legs and the strut. The two legs cooperate with the primary stand to support the primary board.

10 Claims, 12 Drawing Sheets

(56) References Cited

U.S. PATENT DOCUMENTS

| | | | | |
|---|---|---|---|---|
| 9,622,568 | B1 * | 4/2017 | Lin | A47B 13/081 |
| 10,441,069 | B2 * | 10/2019 | Andersson | A47B 1/10 |
| 2006/0021552 | A1 * | 2/2006 | Pleiman | A47B 3/0918 108/132 |
| 2007/0006784 | A1 * | 1/2007 | Thrush | A47B 37/04 108/129 |
| 2020/0093256 | A1 * | 3/2020 | Mansson | A47B 41/02 |

* cited by examiner

EXTENDABLE TABLE ASSEMBLY

BACKGROUND OF THE INVENTION

1. Field of the Invention

The present invention relates to a piece of furniture and, more particularly, to an extendable table (or chair or stool) assembly that is used outdoors.

2. Description of the Related Art

A conventional extendable table in accordance with the prior art shown in FIGS. 1 and 2 comprises a main body 90, two extension racks 91 retractably mounted in the main body 90, and two extension boards 92 laminating the main body 90. In operation, the two extension racks 91 are pulled outward from the main body 90. Then, the two extension boards 92 are inverted outward from the main body 90 and supported by the two extension racks 91. Thus, the two extension boards 92 are connected with the main body 90 to increase the area of usage. However, when a heavy article is placed on one of the two extension boards 92, the force is not distributed evenly so that the conventional extendable table easily falls down. In addition, the main body 90 cannot be folded, thereby causing inconvenience in carrying.

BRIEF SUMMARY OF THE INVENTION

The primary objective of the present invention is to provide an extendable table assembly that has a steady center of gravity.

In accordance with the present invention, there is provided an extendable table assembly comprising a primary board, a support unit mounted on a bottom face of the primary board, a foldable primary stand pivotally connected with the support unit, an extension unit arranged under the primary board and connected with the support unit, a secondary board placed on the extension unit, and a connecting unit mounted between the support unit and the extension unit, to connect the primary board with the extension unit. The extension unit is moved away from the primary board in an expanding direction and moved toward the primary board in a folding direction reciprocatingly. The extension unit includes a strut, an enclosure frame connected with two ends of the strut and connected with the support unit, and a foldable secondary stand movable in concert with the extension unit. The secondary stand includes two legs pivotally connected with the enclosure frame and a V-shaped brace mounted between the two legs and the strut. The two legs cooperate with the primary stand to support the primary board.

In accordance with the present invention, there is further provided an extendable table assembly comprising a primary board, a support unit mounted on a bottom face of the primary board, two extension units arranged under the primary board and connected with the support unit, two secondary boards placed on the two extension units, and two connecting units mounted between the support unit and the two extension units, to connect the primary board with the two extension units. Each of the two extension units is moved away from the primary board in an expanding direction and moved toward the primary board in a folding direction reciprocatingly. Each of the two extension units includes a strut, an enclosure frame connected with two ends of the strut and connected with the support unit, and a foldable secondary stand movable in concert with each of the two extension units. The secondary stand includes two legs pivotally connected with the enclosure frame and a V-shaped brace mounted between the two legs and the strut.

In accordance with the present invention, there is further provided an extendable table assembly comprising a primary board, a support unit mounted on a bottom face of the primary board, a foldable primary stand pivotally connected with the support unit, an extension unit arranged under the primary board and connected with the support unit, a secondary board placed on the extension unit, and a connecting unit mounted between the support unit and the extension unit, to connect the primary board with the extension unit. The extension unit is moved away from the primary board in an expanding direction and moved toward the primary board in a folding direction reciprocatingly. The extension unit includes a strut, an enclosure frame connected with two ends of the strut and connected with the support unit, and a foldable secondary stand movable in concert with the extension unit. The secondary stand includes two legs pivotally connected with the enclosure frame and two secondary hinges pivotally mounted between the enclosure frame and the two legs. The two legs cooperate with the primary stand to support the primary board.

In accordance with the present invention, there is further provided an extendable table assembly comprising a primary board, a support unit mounted on a bottom face of the primary board, two extension units arranged under the primary board and connected with the support unit, two secondary boards placed on the two extension units, and two connecting units mounted between the support unit and the two extension units, to connect the primary board with the two extension units. Each of the two extension units is moved away from the primary board in an expanding direction and moved toward the primary board in a folding direction reciprocatingly. Each of the two extension units includes a strut, an enclosure frame connected with two ends of the strut and connected with the support unit, and a foldable secondary stand movable in concert with each of the two extension units. The secondary stand includes two legs pivotally connected with the enclosure frame and two secondary hinges pivotally mounted between the enclosure frame and the two legs.

According to the primary advantage of the present invention, when the extension unit is moved in the expanding direction, the two legs are moved with the extension unit to leave the primary board, so that when heavy articles are placed on the secondary board, the two legs support the secondary board to prevent the extendable table assembly from falling down or collapsed.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
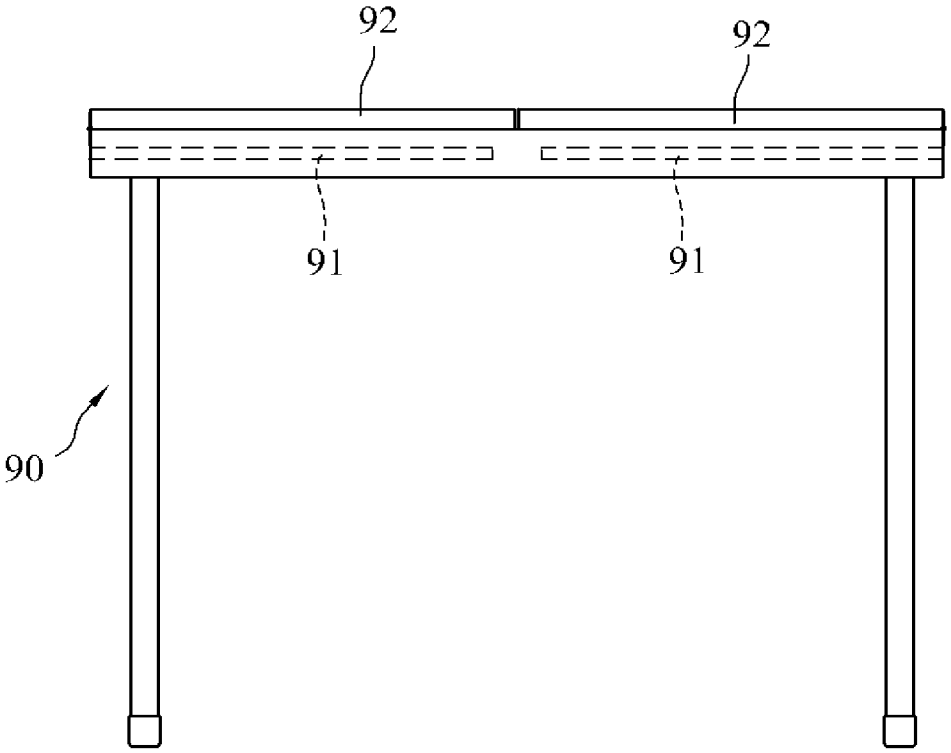
FIG. 1 PRIOR ART
FIG. 1 is a side view of a conventional extendable table in accordance with the prior art.
Figure 2:
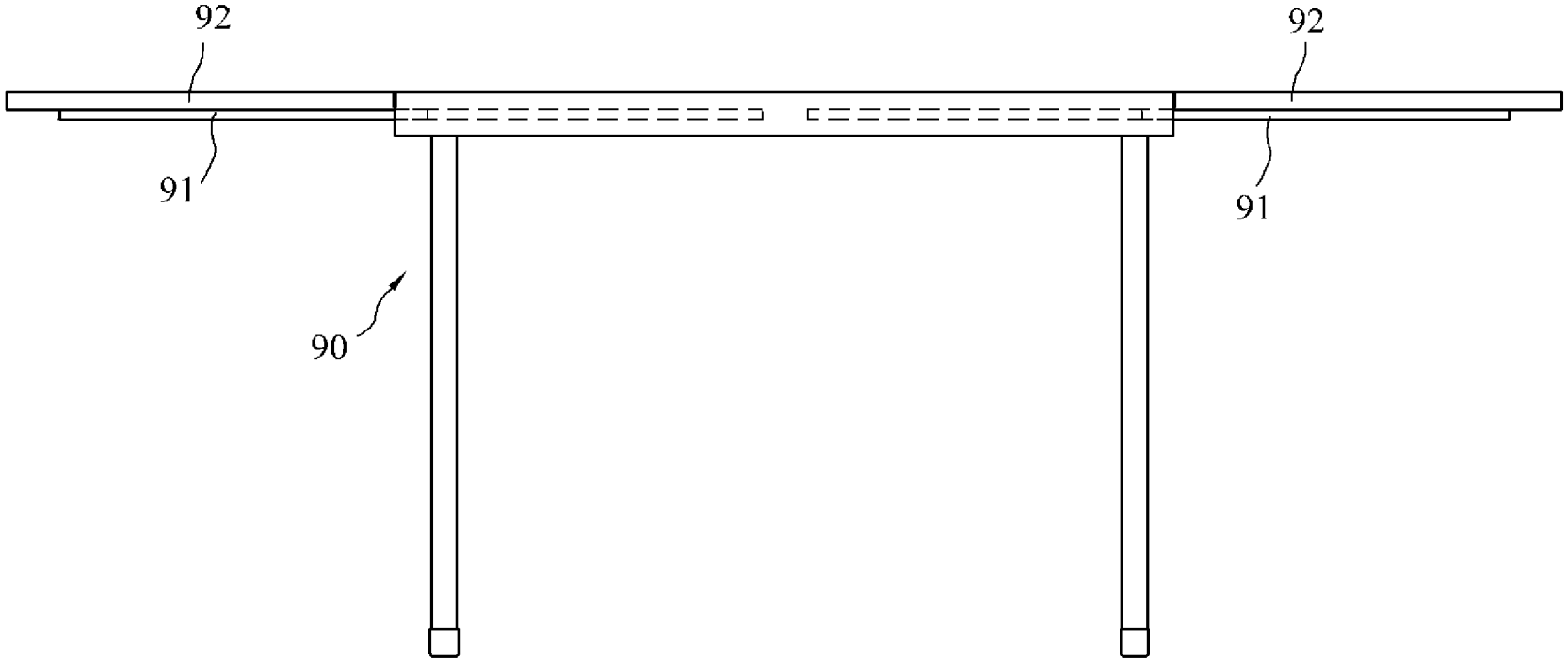
FIG. 2 PRIOR ART
FIG. 2 is a side view showing an expanded state of the conventional extendable table as shown in FIG. 1.
Figure 3:
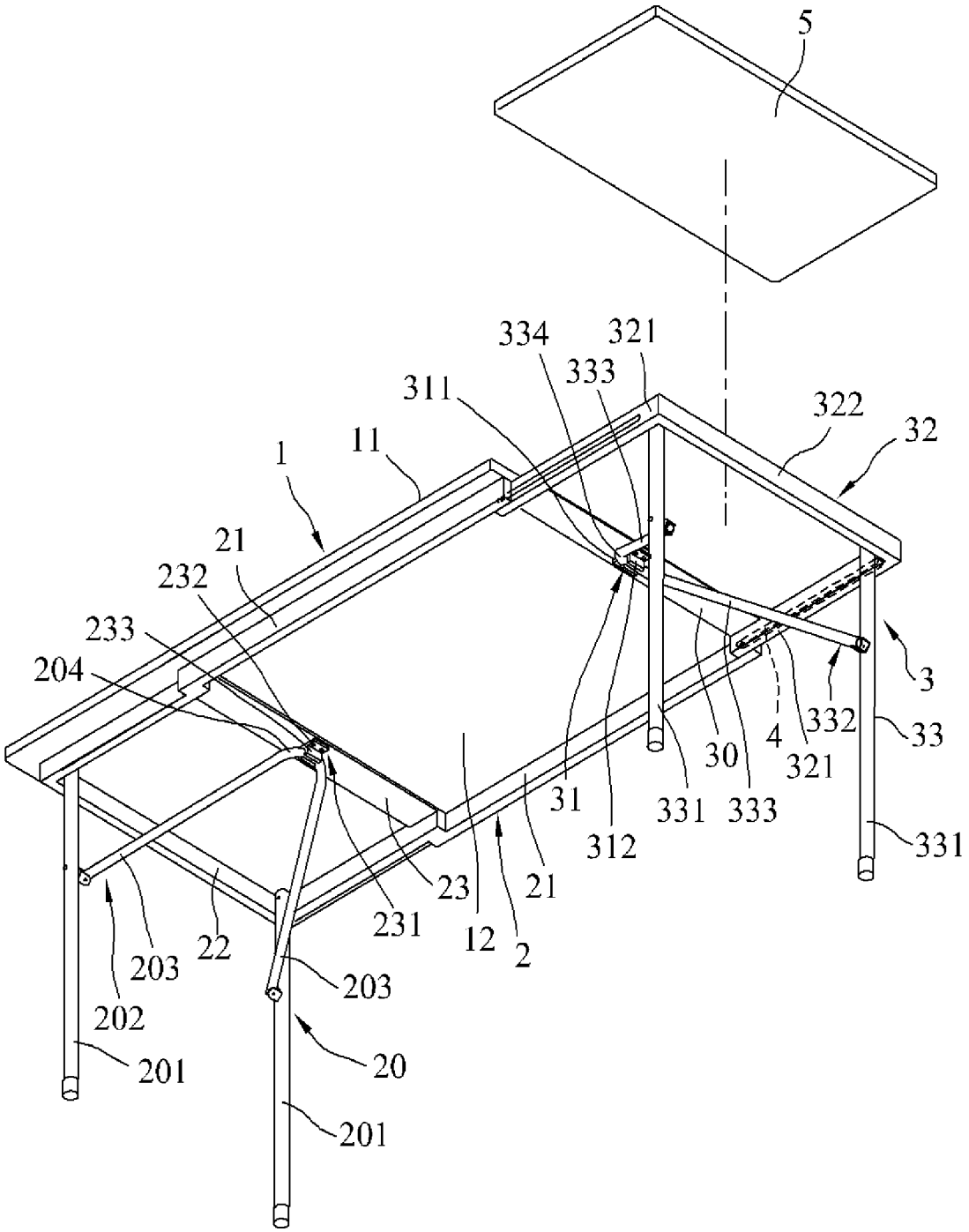
FIG. 3 is a partial exploded perspective view of an extendable table assembly in accordance with the first preferred embodiment of the present invention.
Figure 4:
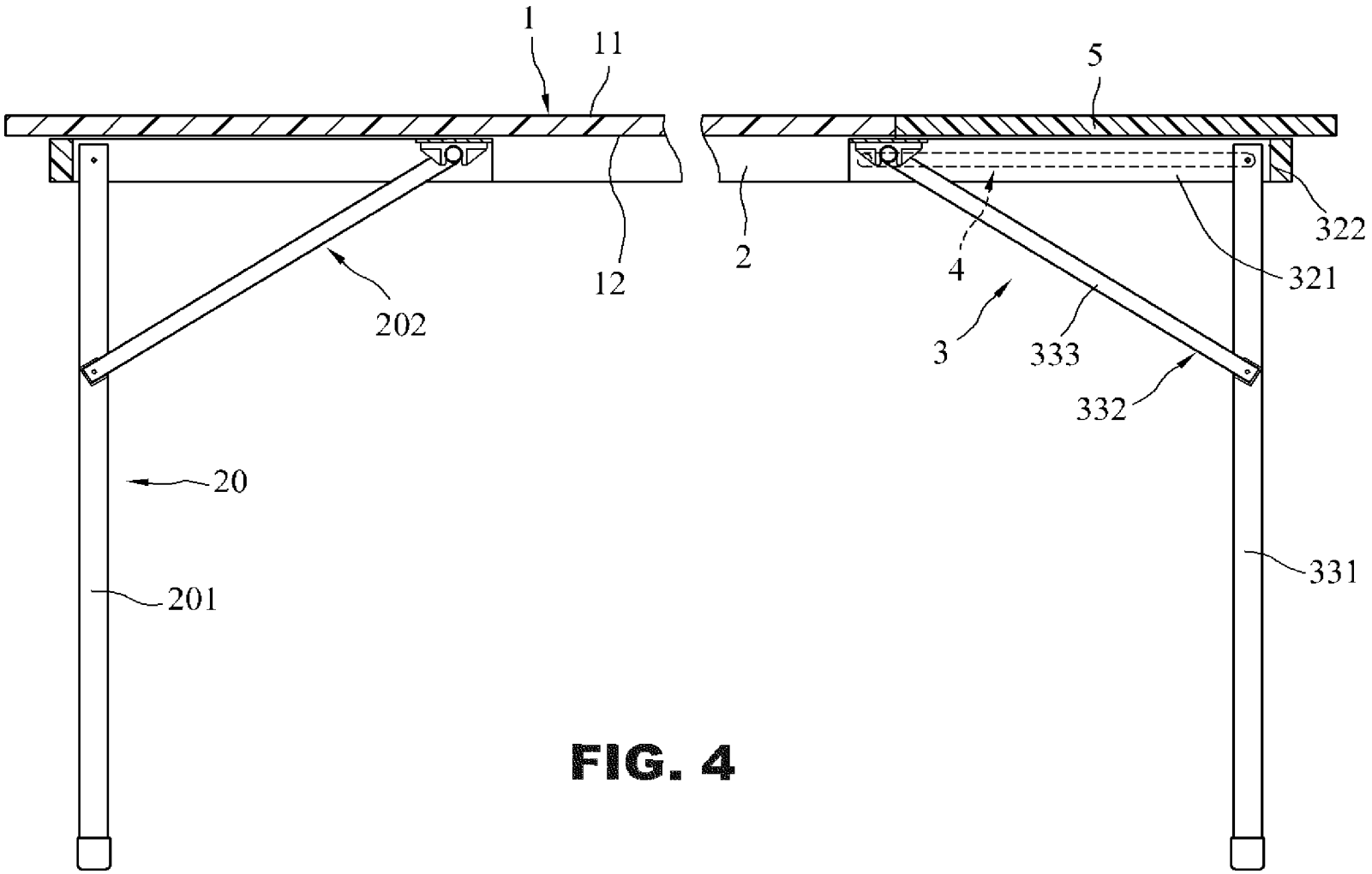
FIG. 4 is a partial side view of the extendable table assembly in accordance with the first preferred embodiment of the present invention.

Referring to the drawings and initially to FIGS. 3 and 4, an extendable table assembly in accordance with the first preferred embodiment of the present invention comprises a primary board 1, a support unit 2 mounted on a bottom face 12 of the primary board 1, a foldable primary stand 20 pivotally connected with the support unit 2, an extension unit 3 arranged under the primary board 1 and connected with the support unit 2, a secondary board 5 placed on the extension unit 3, and a connecting unit 4 mounted between the support unit 2 and the extension unit 3, to connect the primary board 1 with the extension unit 3.

The extension unit 3 is moved away from the primary board 1 in an expanding direction and moved toward the primary board 1 in a folding direction reciprocatingly. The extension unit 3 includes a strut (or base or footing) 30 mounted on the bottom face 12 of the primary board 1, an enclosure frame 32 connected with two ends of the strut 30 and connected with the support unit 2, and a secondary stand 33 mounted between the strut 30 and the enclosure frame 32. The connecting unit 4 is mounted between the support unit 2 and the enclosure frame 32 of the extension unit 3. The secondary stand 33 is movable in concert with the extension unit 3. The secondary stand 33 is foldable and includes two legs 331 pivotally connected with the enclosure frame 32 and a brace 332 mounted between the two legs 331 and the strut 30. The two legs 331 are spaced from each other. The two legs 331 cooperate with the primary stand 20 to support the primary board 1. The brace 332 has a V-shaped configuration. The brace 332 is pivotally connected with the two legs 331 and is removably connected with the strut 30. The extension unit 3 further includes a secondary mounting block 31 mounted on a middle of the strut 30. The brace 332 is inserted into the secondary mounting block 31.

The primary board 1 has a top face 11 opposite to the bottom face 12. The top face 11 is used to place articles. The support unit 2 includes two long rails 21 spaced from each other, a first support rail 22 connecting the two long rails 21, a second support rail 23 connecting the two long rails 21 and spaced from the first support rail 22, and a primary mounting block 231 mounted on a middle of the second support rail 23. The primary mounting block 231 includes a seat 232 connected with the second support rail 23, and a C-shaped holder 233 connecting and extending downward from the seat 232. The primary stand 20 includes two primary legs 201 pivotally connected with the two long rails 21 of the support unit 2, and a primary brace 202 mounted between the two primary legs 201 and the primary mounting block 231. The primary brace 202 has a V-shaped configuration and includes two straight support portions 203 pivotally connected with the two primary legs 201 and a curved portion 204 detachably inserted into the holder 233 of the primary mounting block 231.

The extension unit 3 is connected with the two long rails 21 of the support unit 2. The enclosure frame 32 includes two side rails 321 connected with the two ends of the strut 30 respectively and a connecting rail 322 connecting the two side rails 321. The two side rails 321 extend in the expanding direction and the folding direction. The connecting rail 322 is parallel with the strut 30. The two legs 331 of the secondary stand 33 are pivotally connected with the two side rails 321 of the enclosure frame 32 respectively. The secondary mounting block 31 includes a secondary seat 311 connected with the strut 30, and a C-shaped secondary holder 312 connecting and extending downward from the secondary seat 311. The brace 332 includes two straight support portions 333 pivotally connected with the two legs 331 and a curved portion 334 detachably inserted into the secondary holder 312 of the secondary mounting block 31.

In practice, the extension unit 3 is moved relative to the primary board 1 in the expanding direction and in the folding direction. Thus, when the extension unit 3 is moved to a folded position (not shown), the extension unit 3 is disposed on the bottom face 12 of the primary board 1, and when the extension unit 3 is moved to an expanded position as shown in FIG. 4, the extension unit 3 is distant from the primary board 1.

Figure 5:
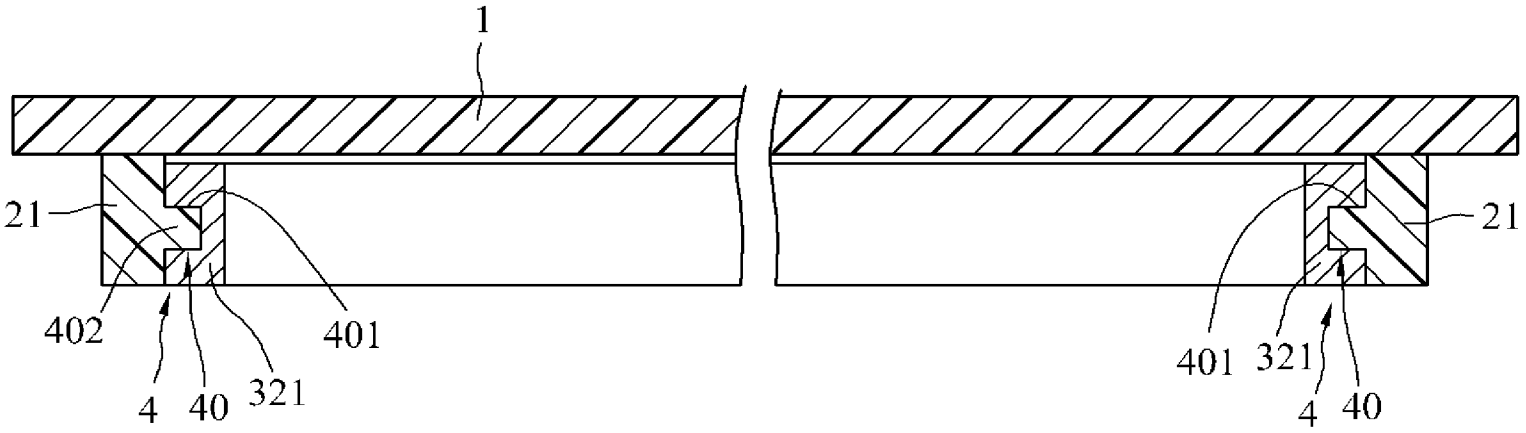
FIG. 5 is a partial cross-sectional view of the extendable table assembly in accordance with the first preferred embodiment of the present invention.

Referring to FIG. 5 with reference to FIGS. 3 and 4, the connecting unit 4 is used to connect the two side rails 321 of the enclosure frame 32 and the two long rails 21 of the support unit 2. The connecting unit 4 includes two slide track modules 40 extending in the expanding direction and in the folding direction. Each of the two slide track modules 40 includes a slide guide 402 connecting each of the two long rails 21, and a slideway 401 formed in each of the two side rails 321 and slidably mounted on the slide guide 402. Thus, the slideway 401 is moved on the slide guide 402 to guide movement of each of the two side rails 321 relative to each of the two long rails 21, so that the extension unit 3 is moved in the expanding direction to the expanded position or moved in the folding direction to the folded position.

As shown in FIG. 3, the secondary board 5 is detachably mounted on the extension unit 3 to extend the area of the primary board 1.

Figure 6:
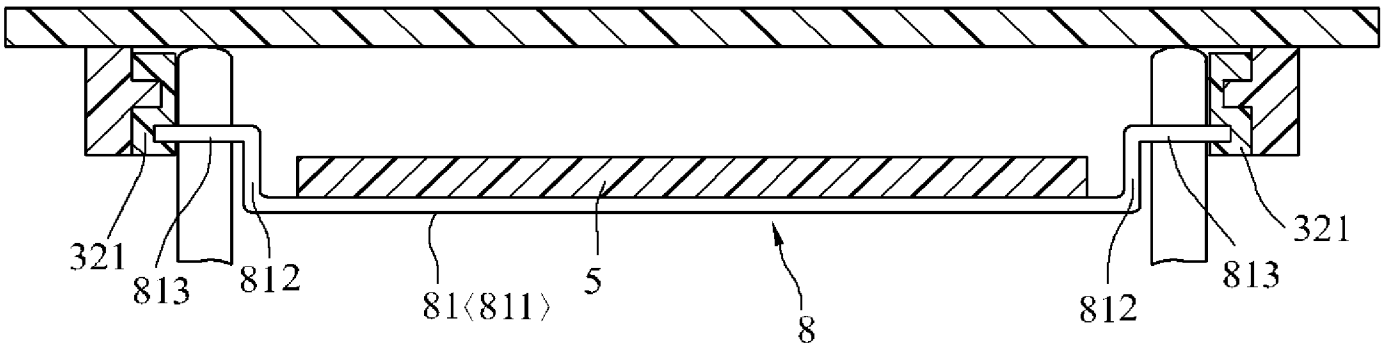
FIG. 6 is another partial cross-sectional view of the extendable table assembly in accordance with the first preferred embodiment of the present invention.

Referring to FIG. 6, the extendable table assembly further comprises a rack unit 8 removably mounted on the enclosure frame 32. The rack unit 8 includes two storage bars 81 each mounted between the two side rails 321 of the enclosure frame 32. Each of the two storage bars 81 has a main body 811 for bearing the secondary board 5, two vertical portions 812 extending upward from two ends of the main body 811, and two connecting portions 813 each connecting and extending outward from a top of one of the two vertical portions 812. The two connecting portions 813 are connected with the two side rails 321 of the enclosure frame 32. The rack unit 8 is folded toward the primary board 1 when not in use.

In operation, the two primary legs 201 and the two legs 331 are pivoted and moved away from the primary board 1. Then, the curved portion 204 of the primary brace 202 is inserted into the holder 233 of the primary mounting block 231, and the curved portion 334 of the brace 332 is inserted into the secondary holder 312 of the secondary mounting block 31. Thus, the primary stand 20 and the secondary stand 33 are expanded to support the primary board 1. Then, the extension unit 3 is moved to the expanded position and exposed from the primary board 1. Thus, the extendable table assembly is expanded. Then, the secondary board 5 is placed on the enclosure frame 32 of the extension unit 3, to increase the area of the extendable table assembly.

When the extendable table assembly is to be collapsed, the secondary board 5 is removed from the enclosure frame 32 of the extension unit 3. Then, the extension unit 3 is moved in the folding direction to reach the folded position so that the extension unit 3 is folded to the bottom face 12 of the primary board 1. Then, the curved portion 334 of the brace 332 is detached from the secondary holder 312 of the secondary mounting block 31, and drives the two legs 331 to pivot and move toward the primary board 1. Then, the curved portion 204 of the primary brace 202 is detached from the holder 233 of the primary mounting block 231, and drives the two primary legs 201 to pivot and move toward the primary board 1. In such a manner, the primary stand 20 and the secondary stand 33 are folded. Then, the secondary board 5 is placed on and stored by the two storage bars 81.

In conclusion, when the extension unit 3 is moved to the expanded position, the strut 30 bears the weight of the primary board 1 to prevent the primary board 1 from being deformed. The strut 30 connects the enclosure frame 32 to enhance the strength of the enclosure frame 32. The brace 332 is inserted into the secondary mounting block 31 to distribute the weight of the primary board 1 on the two legs 331. The brace 332 is detached from the secondary mounting block 31, and drives the two legs 331 to pivot and move toward the primary board 1. The two legs 331 are moved with the extension unit 3 when the extension unit 3 is moved in the expanding direction and in the folding direction so that the two legs 331 support the weight of the primary board 1 to prevent the extendable table assembly from falling down or collapsed.

Figure 7:
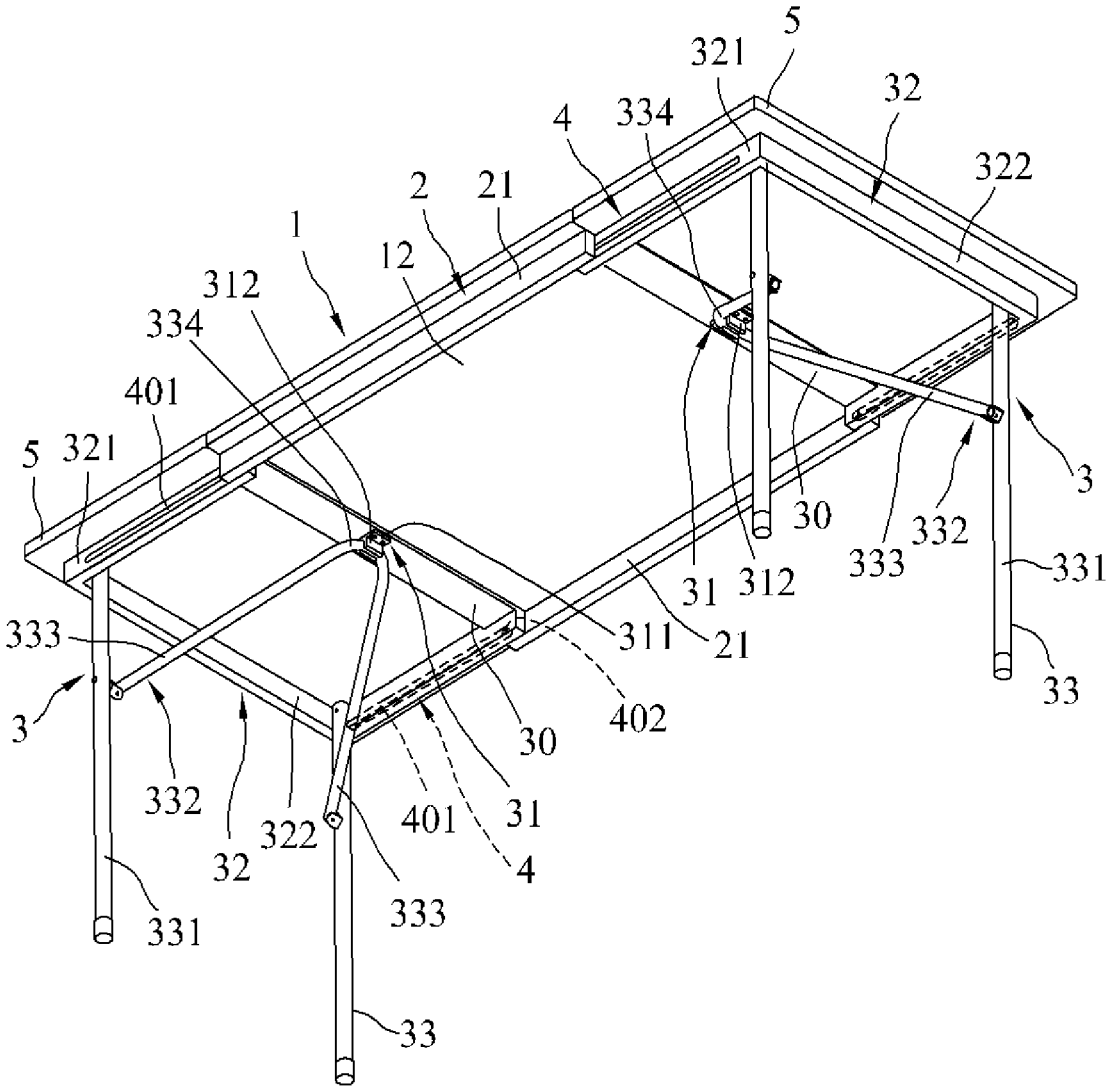
FIG. 7 is a perspective view of an extendable table assembly in accordance with the second preferred embodiment of the present invention.
Figure 8:
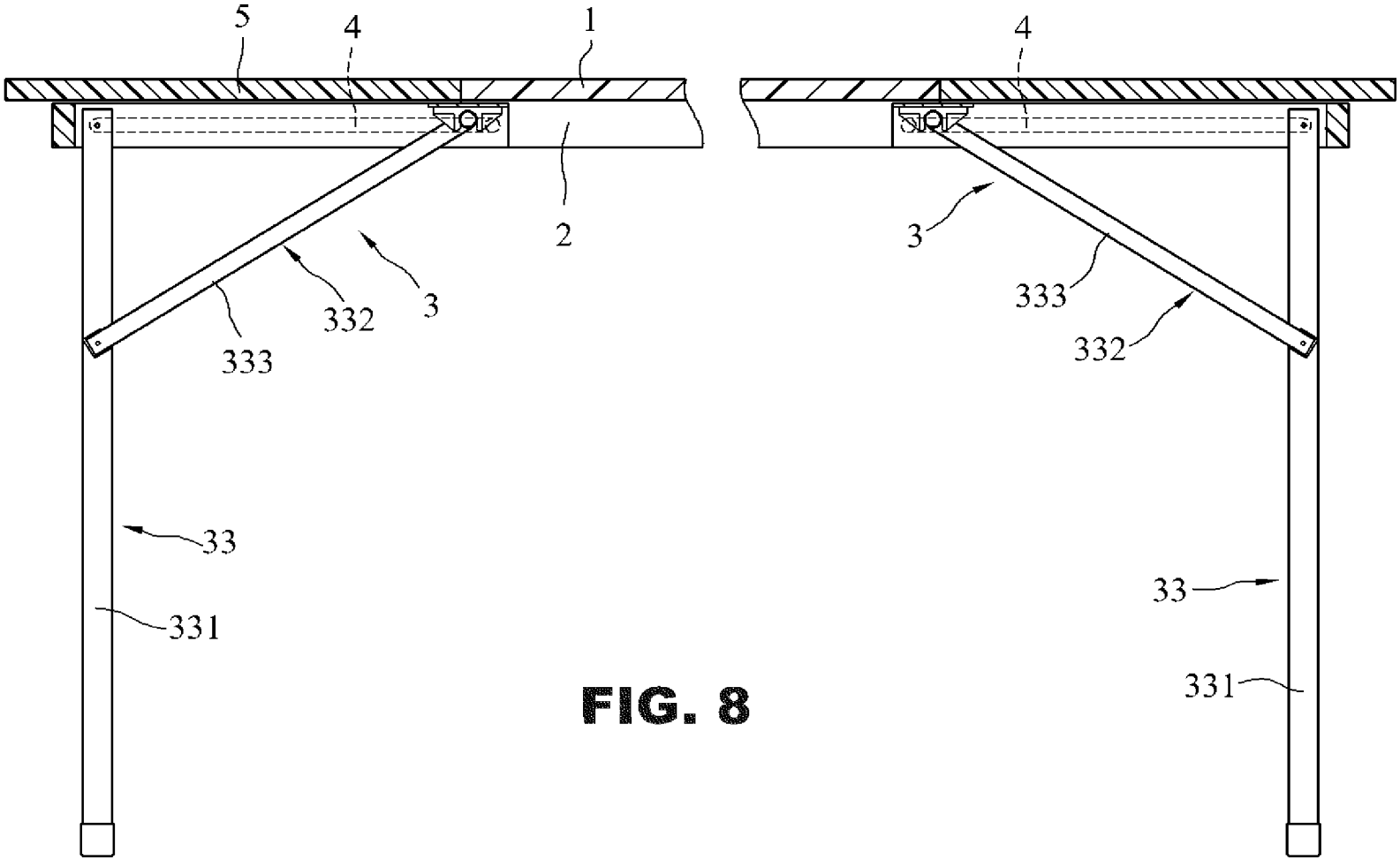
FIG. 8 is a partial cross-sectional view of the extendable table assembly in accordance with the second preferred embodiment of the present invention.

Referring to FIGS. 7 and 8, the difference between the second preferred embodiment and the first preferred embodiment is described as follows.

The extendable table assembly in accordance with the second preferred embodiment of the present invention comprises a support unit 2 mounted on the bottom face 12 of the primary board 1, two extension units 3 arranged under the primary board 1 and connected with the support unit 2, two secondary boards 5 placed on the two extension units 3, and two connecting units 4 each mounted between the support unit 2 and one of the two extension units 3. The support unit 2 includes two long rails 21 arranged on the bottom face 12 of the primary board 1

In operation, the two legs 331 are pivoted and moved away from the primary board 1. Then, the curved portion 334 of the brace 332 is inserted into the secondary holder 312 of the secondary mounting block 31. Thus, the secondary stands 33 are expanded to support the primary board 1. Then, the two extension units 3 are moved to the expanded position and exposed from the primary board 1. Thus, the extendable table assembly is expanded. Then, the secondary board 5 are placed on the enclosure frames 32, to increase the area of the extendable table assembly.

When the extendable table assembly is to be collapsed, the secondary boards 5 are removed from the enclosure frames 32. Then, the two extension units 3 are moved in the folding direction to reach the folded position so that the two extension units 3 are folded to the bottom face 12 of the primary board 1. Then, the curved portion 334 of the brace 332 is detached from the secondary holder 312 of the secondary mounting block 31, and drives the two legs 331 to pivot and move toward the primary board 1. In such a manner, the secondary stands 33 are folded.

Figure 9:
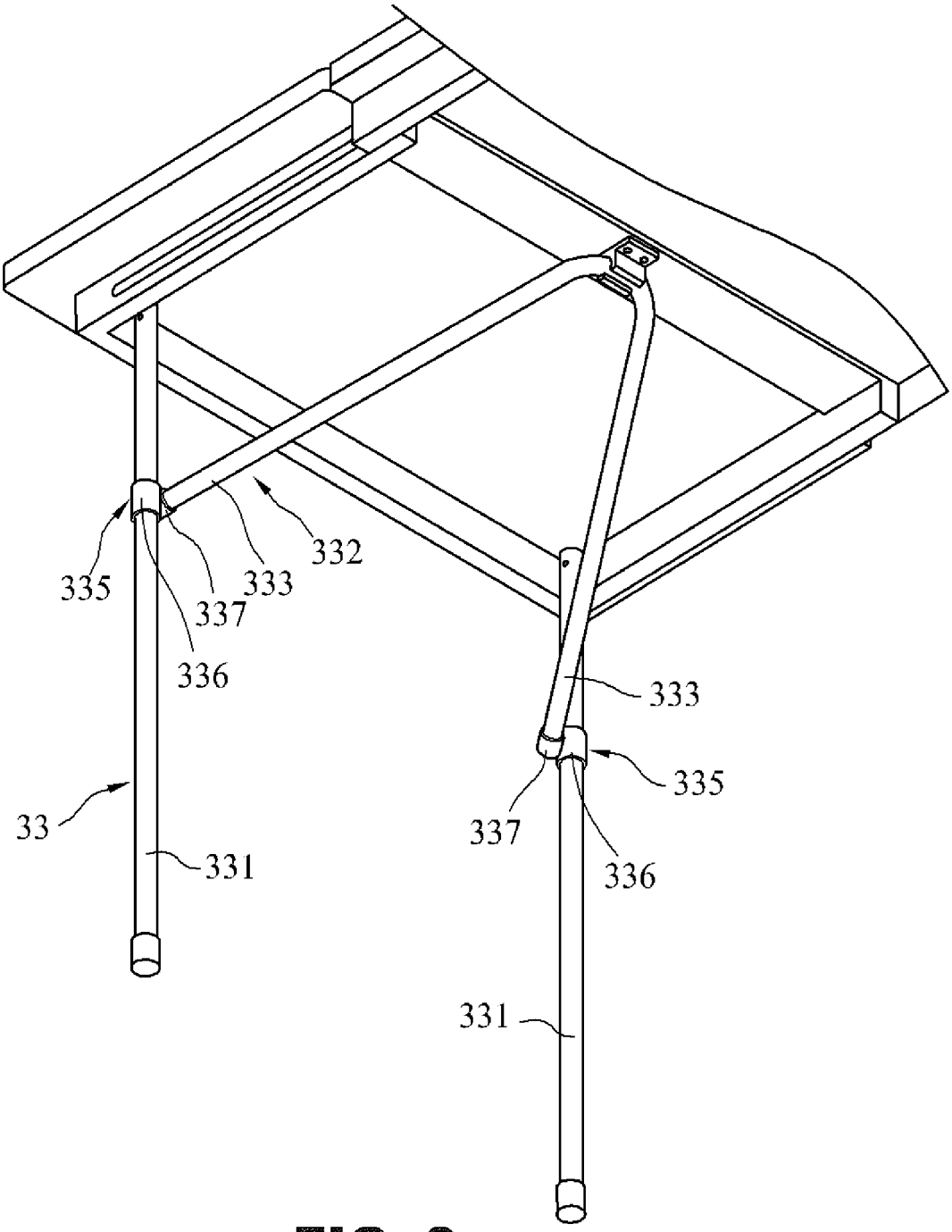
FIG. 9 is a partial perspective view of an extendable table assembly in accordance with the third preferred embodiment of the present invention.

Referring to FIG. 9, the difference between the third preferred embodiment and the second preferred embodiment is described as follows.

The secondary stand 33 further includes two sockets 335. Each of the two sockets 335 has a straight mounting portion 336 and an oblique mounting portion 337 pivotally connected with the straight mounting portion 336. The straight mounting portion 336 is mounted on one of the two legs 331. The oblique mounting portion 337 is mounted on one of the two straight support portions 333 of the brace 332. Thus, the two sockets 335 connect the brace 332 and the two legs 331.

Figure 10:
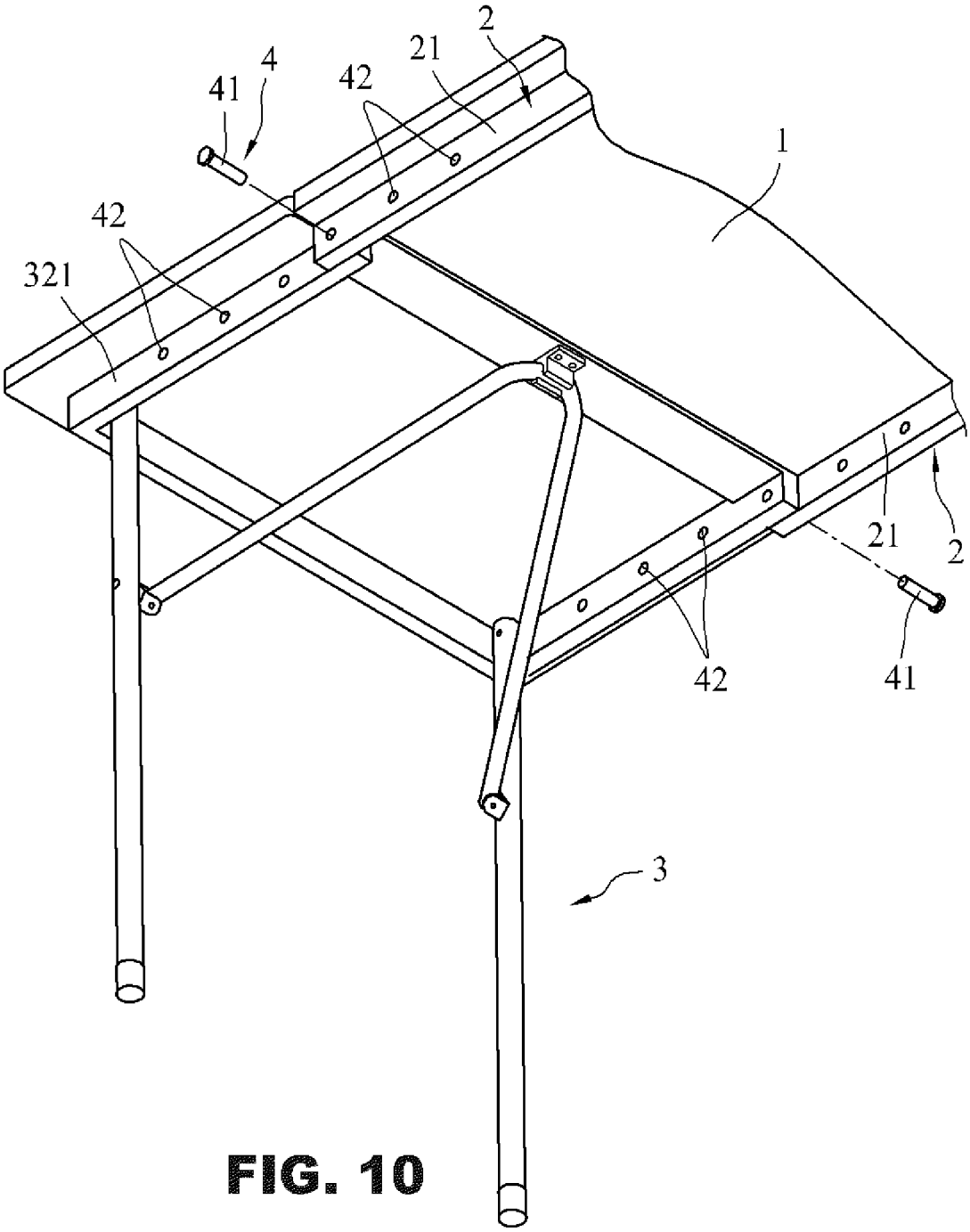
FIG. 10 is a partial perspective view of an extendable table assembly in accordance with the fourth preferred embodiment of the present invention.

Referring to FIG. 10, the difference between the fourth preferred embodiment and the second preferred embodiment is described as follows.

Each of the two long rails 21 and each of the two side rails 321 are provided with a plurality of pin holes 42, and each of the two connecting units 4 includes two pins 41 each inserted into one of the pin holes 42 respectively to secure the primary board 1 and each of the two extension units 3.

Figure 11:
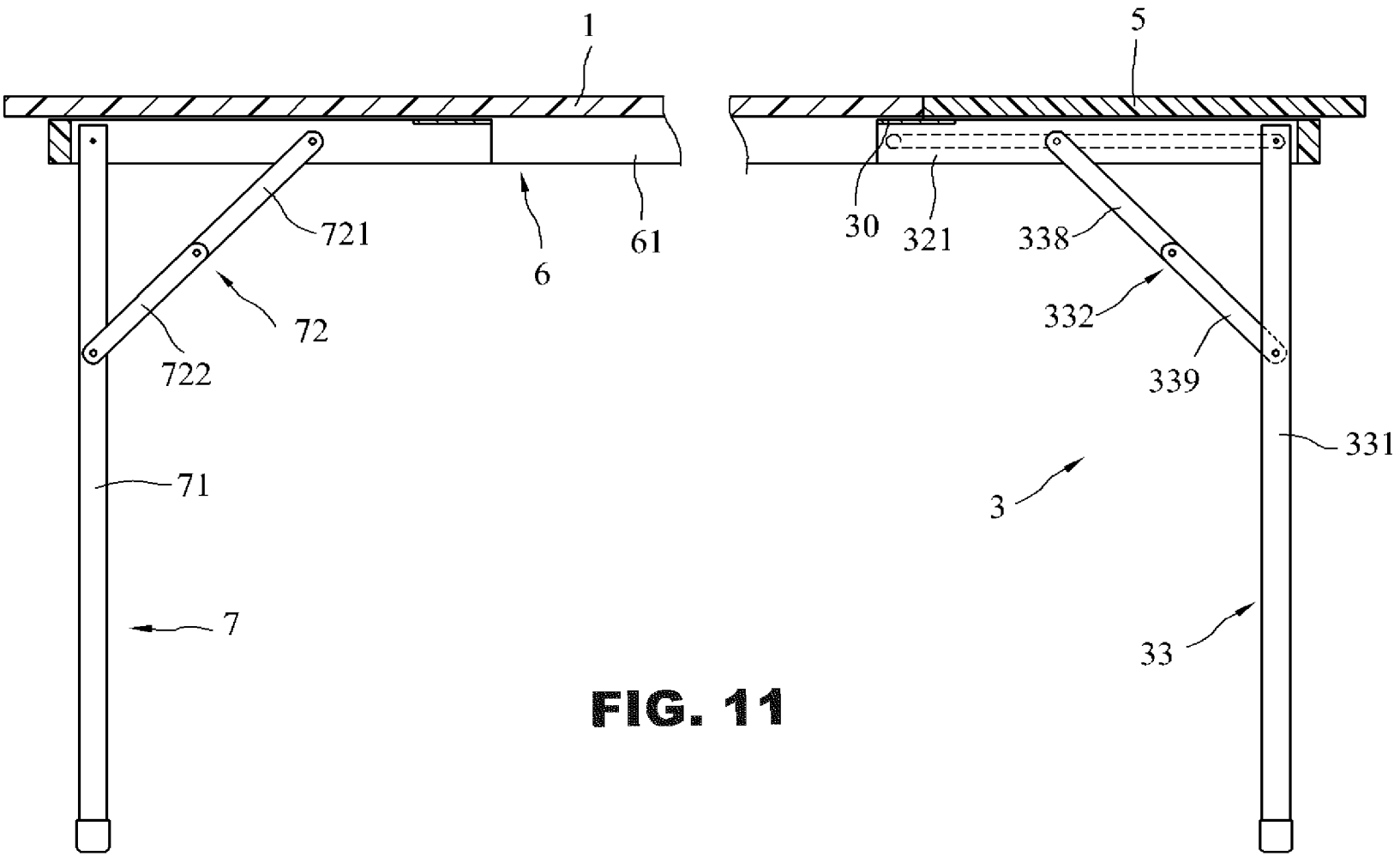
FIG. 11 is a partial cross-sectional view of the extendable table assembly in accordance with the fifth preferred embodiment of the present invention.

Referring to FIG. 11, the difference between the fifth preferred embodiment and the first preferred embodiment is described as follows.

The extendable table assembly in accordance with the fifth preferred embodiment of the present invention comprises a support rack 6 mounted on the bottom face 12 of the primary board 1, a primary stand 7 pivotally connected with the support rack 6, and an extension unit 3 connected with the support rack 6. The support rack 6 includes two support rails 61 mounted on the primary board 1. The primary stand 7 includes two primary legs 71 pivotally connected with the two support rails 61, and two primary hinges 72 pivotally mounted between the two support rails 61 and the two primary legs 71. Each of the two primary hinges 72 includes a first leaf 721 and a second leaf 722 pivotally connected with the first leaf 721. The extension unit 3 includes two secondary hinges 332 pivotally mounted between the two side rails 321 and the two legs 331. Each of the two secondary hinges 332 includes a first leaf 338 pivotally connected with one of the two side rails 321 and a second leaf 339 pivotally connected with one of the two legs 331. The second leaf 339 is pivotally connected with the first leaf 338.

In operation, the two primary legs 71 and the two legs 331 are pivoted and moved away from the primary board 1 so that the two primary hinges 72 and the two secondary hinges 332 are stretched. the primary stand 7 and the secondary stand 33 are expanded to support the primary board 1. When the extendable table assembly is to be collapsed, the pivot point of the first leaf 338 and the second leaf 339 is pressed to bend each of the two secondary hinges 332 so as to fold each of the two primary legs 71, while the pivot point of the first leaf 721 and the second leaf 722 is pressed to bend each of the two primary hinges 72 so as to fold each of the two legs 331.

Figure 12:
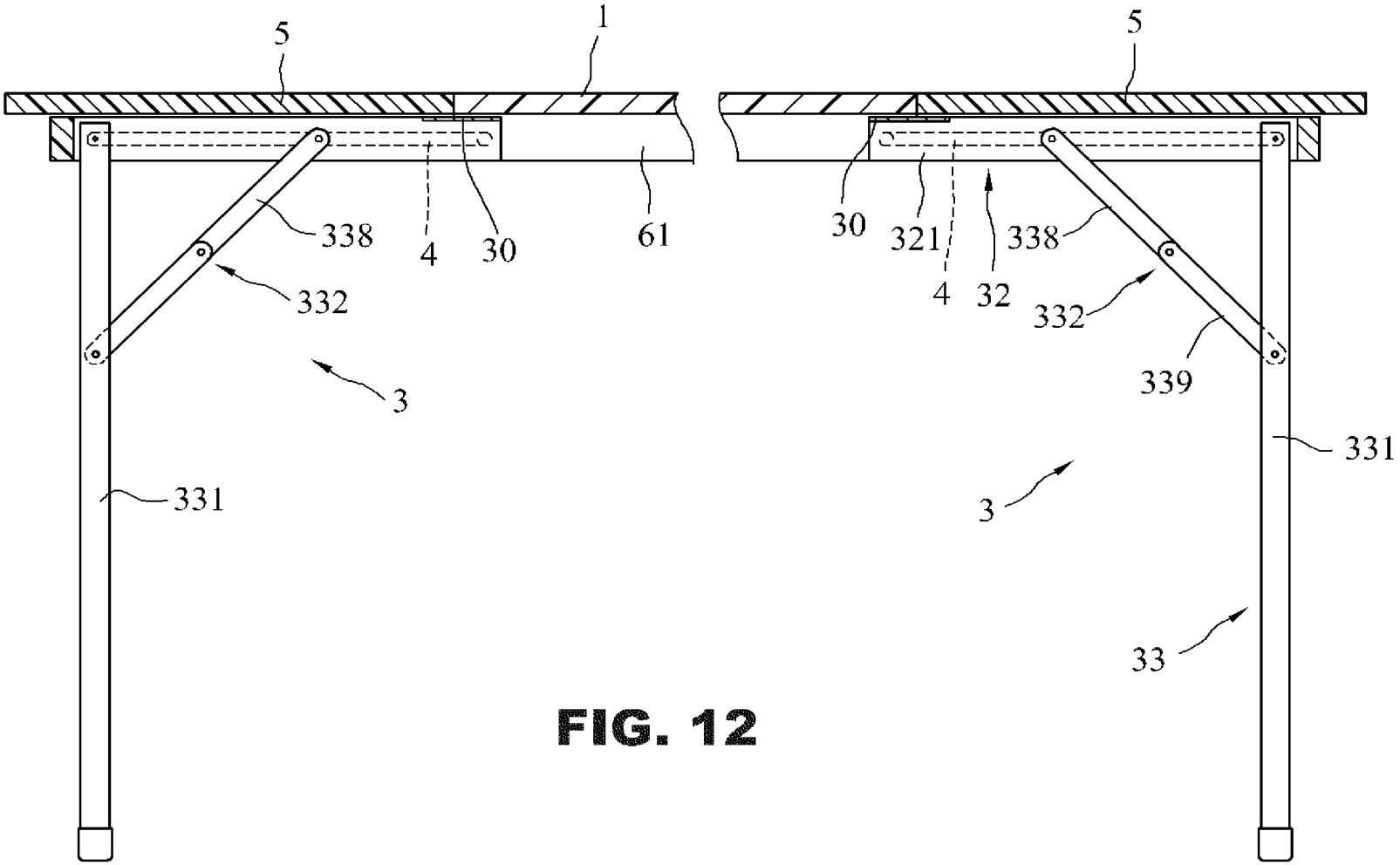
FIG. 12 is a partial cross-sectional view of the extendable table assembly in accordance with the sixth preferred embodiment of the present invention.

Referring to FIG. 12, the difference between the sixth preferred embodiment and the fifth preferred embodiment is described as follows.

The extendable table assembly in accordance with the sixth preferred embodiment of the present invention comprises two extension units 3 arranged under the primary board 1 and connected with the two support rails 61, two secondary boards 5 placed on the two extension units 3, and two connecting units 4 each connecting the two support rails 61 and one of the two extension units 3. Thus, the two extension units 3 are moved to the expanded position so that the two extension units 3 are exposed from the primary board 1, or moved to the folded position so that the two extension units 3 are folded under the primary board 1.

Accordingly, when the extension unit 3 is moved in the expanding direction or in the folding direction, the two legs 331 are moved with the extension unit 3 to leave or approach the primary board 1, so that when heavy articles are placed on the secondary board 5, the two legs 331 support the secondary board 5 to prevent the extendable table assembly from falling down or collapsed. In addition, the strut 30 bears the weight of the primary board 1, and the brace 332 distributes the weight to the two legs 331, so that the extendable table assembly is supported steadily. Further, the secondary stand 33 has a foldable structure so that the two legs 331 are folded to and stored by the primary board 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An extendable table assembly comprising:

a primary board;

a support unit mounted on a bottom face of the primary board;

a foldable primary stand pivotally connected with the support unit;

an extension unit arranged under the primary board and connected with the support unit;

a secondary board placed on the extension unit; and a connecting unit mounted between the support unit and the extension unit, to connect the primary board with the extension unit;

wherein:

the extension unit is moved away from the primary board in an expanding direction and moved toward the primary board in a folding direction reciprocatingly;

the extension unit includes a strut, an enclosure frame connected with two ends of the strut and connected with the support unit, and a foldable secondary stand movable in concert with the extension unit;

the secondary stand includes two legs each having an upper end pivotally connected with the enclosure frame and a V-shaped brace mounted between the two legs and the strut;

the two legs cooperate with the primary stand to support the primary board;

the strut of the extension unit is mounted on the bottom face of the primary board;

the enclosure frame includes two side rails connected with the two ends of the strut respectively and a connecting rail connecting the two side rails;

the support unit and each of the two side rails are provided with a plurality of pin holes; and the connecting unit includes two pins each inserted into one of the pin holes respectively to secure the support unit and the two side rails.

2. The extendable table assembly as claimed in claim 1, wherein:

the enclosure frame includes two side rails connected with the two ends of the strut respectively and a connecting rail connecting the two side rails;

the connecting unit connects the support unit and the enclosure frame;

the connecting unit includes two slide track modules extending in the expanding direction and in the folding direction;

each of the two slide track modules includes a slide guide connecting the support unit, and a slideway formed in each of the two side rails and slidably mounted on the slide guide; and the slideway is moved on the slide guide.

3. The extendable table assembly as claimed in claim 1, wherein the upper end of each of the two legs of the secondary stand is disposed in the enclosure frame.

4. The extendable table assembly as claimed in claim 1, wherein the foldable primary stand includes two primary legs each having an upper end pivotally connected with the bottom face of the primary board.

5. The extendable table assembly as claimed in claim 1, wherein the foldable primary stand and the foldable secondary stand of the extension unit support two opposite ends of the primary board.

6. An extendable table assembly comprising:

a primary board;

a support unit mounted on a bottom face of the primary board;

a foldable primary stand pivotally connected with the support unit;

an extension unit arranged under the primary board and connected with the support unit;

a secondary board placed on the extension unit; and a connecting unit mounted between the support unit and the extension unit, to connect the primary board with the extension unit;

wherein:

the extension unit is moved away from the primary board in an expanding direction and moved toward the primary board in a folding direction reciprocatingly;

the extension unit includes a strut, an enclosure frame connected with two ends of the strut and connected with the support unit, and a foldable secondary stand movable in concert with the extension unit;

the secondary stand includes two legs each having an upper end pivotally connected with the enclosure frame and a V-shaped brace mounted between the two legs and the strut;

the two legs cooperate with the primary stand to support the primary board;

the brace is pivotally connected with the two legs and is removably connected with the strut;

the extension unit further includes a secondary mounting block secured on a middle of the strut; and the brace is locked in and clamped by the secondary mounting block.

7. The extendable table assembly as claimed in claim 6, wherein the brace of the secondary stand includes two straight support portions pivotally connected with the two legs of the secondary stand and a curved portion connecting the two straight support portions and inserted into and clamped by the secondary mounting block of the extension unit.

8. The extendable table assembly as claimed in claim 6, wherein the secondary mounting block of the extension unit has a C-shaped configuration.

9. The extendable table assembly as claimed in claim 1, wherein the extendable table assembly serves as a table when the extension unit is fully extended from the primary board and serves as a shelf when the extension unit is partially extended from the primary board.

10. The extendable table assembly as claimed in claim 6, wherein the secondary mounting block of the extension unit has an opening facing downward.

* * * * *